US006299295B1

(12) United States Patent
Miura et al.

(10) Patent No.: US 6,299,295 B1
(45) Date of Patent: Oct. 9, 2001

(54) INK JET PRINTING HEAD HAVING INK CHAMBERS ARRANGED IN SUCCESSION BY LAMINATION

(75) Inventors: Masayoshi Miura, Kawasaki; Masaichiro Tatekawa, Minoo; Yoshiyuki Sugiyama, Ayase; Masahiko Hashimoto, Tokyo; Kiyohide Amemiya, Fujisawa, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/254,220

(22) PCT Filed: Jun. 26, 1998

(86) PCT No.: PCT/JP98/02884

§ 371 Date: Apr. 6, 1999

§ 102(e) Date: Apr. 6, 1999

(87) PCT Pub. No.: WO99/01283

PCT Pub. Date: Jan. 14, 1999

(30) Foreign Application Priority Data

Jul. 3, 1997 (JP) ..... 9-177949
Jun. 9, 1998 (JP) ..... 10-160132

(51) Int. Cl.[7] ..... B41J 2/045
(52) U.S. Cl. ..... 347/68; 347/71; 347/94
(58) Field of Search ..... 347/94, 68, 70, 347/71, 72

(56) References Cited

U.S. PATENT DOCUMENTS 4,700,203 * 10/1987 Yamamure et al. ..... 347/68
5,446,485 * 8/1995 Usui et al. ..... 347/72
5,670,999 * 9/1997 Takeuchi et al. ..... 347/70
5,801,731 * 9/1998 Takahashi ..... 347/71 X
5,828,393 * 10/1998 Hotomi ..... 347/71

FOREIGN PATENT DOCUMENTS 4-126258 4/1992 (JP) .
4-279354 10/1992 (JP) .
06040030 2/1994 (JP) .
6-238894 8/1994 (JP) .

OTHER PUBLICATIONS

Japanese language search report for Int'l Appln No. PCT/JP98/02884 dated Oct. 27, 1998.

English translation of Japanese search report.

* cited by examiner

*Primary Examiner*—Benjamin R. Fuller
*Assistant Examiner*—C. Dickens
(74) *Attorney, Agent, or Firm*—Ratner & Prestia

(57) ABSTRACT

An ink jet printing head comprises a plurality of ink liquid chambers (pressure chambers) 13 connected to an ink supply source and arranged in a predetermined direction and a plurality of nozzles 11*a* individually connected to the ink liquid chambers 13 and arranged in the predetermined direction. Plate-shaped members 14, 15, 17 and 18 lying between the ink liquid chambers 13 and having a piezoelectric plate member capable of discharging ink in the ink liquid chambers are arranged by being laminated in the arrangement direction of the nozzles 11*a*. By this configuration, a multi-nozzle ink jet printing head with high-density nozzle arrangement can be realized.

14 Claims, 12 Drawing Sheets

(a)

(b)

(c)

INK JET PRINTING HEAD HAVING INK CHAMBERS ARRANGED IN SUCCESSION BY LAMINATION

THIS APPLICATION IS A U.S. NATIONAL PHASE APPLICATION OF PCT INTERNATIONAL APPLICATION PCT/JP98/02884.

TECHNICAL FIELD

The present invention relates to an ink jet printing head and a manufacturing method therefor and, more particularly, to an ink jet printing head capable of being suitably used for a printer which records and forms, for example, characters, figures, images, and the like on a recording medium and a manufacturing method therefor.

BACKGROUND ART

In recent years, personal computers have been widely used in a multimedia information society, and accordingly the demand for printers has been increased.

In particular, ink jet printers are low in price and capable of high-quality color print, so that their market has been growing rapidly.

The ink jet printers are available in various systems: a system in which a mechanical vibrating force is converted into pressure waves of ink by using a piezoelectric element and thereby ink droplets are discharged, a system in which bubbles are produced by suddenly heating ink and thereby ink droplets are discharged by the pressure waves of bubbles, a system in which ink is sucked and allowed to fly by an electrostatic force, and so on. Among these systems, the system using a piezoelectric element has received special attention because the manufacturing method of piezoelectric elements has advanced.

The following is a description of a conventional ink jet printing head using a piezoelectric element.

FIG. 12 shows a configuration of a conventional ink jet printing head using a piezoelectric element, which has been disclosed in Japanese Patent Application Laid-Open No. 6-40030.

FIG. 12(*a*) is a sectional view, and FIG. 12(*b*) is a top view. In these figures, reference numeral 101 denotes a nozzle plate, 102 denotes a flow path plate, and 103 denotes an orifice plate. These elements are joined with an adhesive to form an ink nozzle portion 110.

Also, reference numeral 104 denotes a connection plate, 105 denotes a spacer plate, and 106 denotes a closure plate. These elements form an ink pump portion 111 by integrally firing materials fabricated in a green sheet state in three layers.

On top of the ink pump portion 111, a piezoelectric/electrostrictive material 108 provided with electrodes 107 and 109 is formed by printing and firing.

In the ink jet printing head thus configured, ink is caused to flow through an ink supply path 113, an ink supply flow path 114 and a pressure chamber 115 are filled with ink, and ink droplets are discharged through nozzles 116 by the vibration of piezoelectric/electrostrictive element 108 caused by a predetermined electrical signal.

For such a conventional configuration, however, in arranging the nozzles 116 with high density, there is a technical limitation in minute fabrication of the spacer plate 105 and minute formation of piezoelectric/electrostrictive element 108 and the electrodes 107 and 109 by printing etc. Thereupon, the conventional configuration has a problem in that it is very difficult to produce a multi-nozzle head having a nozzle arrangement of high resolution such as 8 nozzles/mm or 16 nozzles/mm.

Further, many flat-plate members with different patterns, that is, 9-layer members with different patterns including the electrodes must be fabricated, formed, and laminated, which presents a problem in that the manufacture is complicated.

DISCLOSURE OF THE INVENTION

The present invention has been made to solve the above problems, and accordingly an object of the present invention is to provide a multi-nozzle ink jet printing head with high-density nozzle arrangement, and a manufacturing method by which the head can be manufactured at a low cost with high productivity.

The present invention provides an ink jet printing head comprising a plurality of ink liquid chambers connected to an ink supply source and arranged in a predetermined direction and a plurality of nozzles individually connected to the ink liquid chambers and arranged in the predetermined direction, characterized in that plate-shaped members lying between the ink liquid chambers and having a driving function capable of discharging ink in all or some ink liquid chambers are arranged by being laminated in the arrangement direction of the nozzles.

By this configuration, a multi-nozzle ink jet printing head with high-density nozzle arrangement can be realized.

Also, the present invention provides an ink jet printing head in which the plate-shaped members include:

a plate-shaped piezoelectric/electrostrictive member;

first and second electrode members disposed adjacently on the opposite sides of the piezoelectric/electrostrictive member; and a plate-shaped regulating plate member disposed adjacently to the second electrode member on the side of the second electrode member, the ink liquid chamber is formed by a hole portion of a plate-shaped pressure chamber member disposed adjacently to the first electrode member on the side of the first electrode member, and extension or contraction deformation is allowed to occur on the piezoelectric/electrostrictive member by applying a voltage to the first and second electrode members, and the regulating plate member regulates the extension or contraction deformation of the piezoelectric/electrostrictive member, whereby the ink in the ink liquid chamber is pressurized and ink droplets are discharged through the nozzle corresponding to the ink liquid chamber.

By this configuration, the electrode pattern formed in the plate-shaped member may be a relatively simple one with a large size as compared with the nozzle arrangement density, so that the fabrication is simple and the manufacture is easy.

Also, by making the first electrode a common electrode, chemical change etc. of ink is not produced.

Also, the present invention provides a manufacturing method for an ink jet printing head comprising a laminating step of alternately laminating a base material for a pressure chamber member having a plurality of hole portions corresponding to ink liquid chambers connected to an ink supply source and a base material for a driving plate-shaped member capable of deforming all or some of the ink liquid chambers; and a cutting step of cutting the base material for the pressure chamber member and the base material for the plate-shaped member, which are laminated in the laminating step, along the laminating direction so as to correspond to the hole portions while keeping the laminated state.

Thus, if cutting and separating are performed after laminating, a large number of ink jet printing heads can be manufactured at a time, so that an ink jet printing head with very high productivity can be provided.

Also, the present invention provides a manufacturing method for an ink jet printing head further comprising a joining step for joining a base material for a nozzle plate having a plurality of nozzles capable of being connected to the ink liquid chambers so that the nozzles correspond to the ink liquid chambers after the laminating step and before the cutting step.

By this configuration, the nozzles can be positioned accurately and easily.

DESCRIPTION OF SYMBOLS

Figure 1:
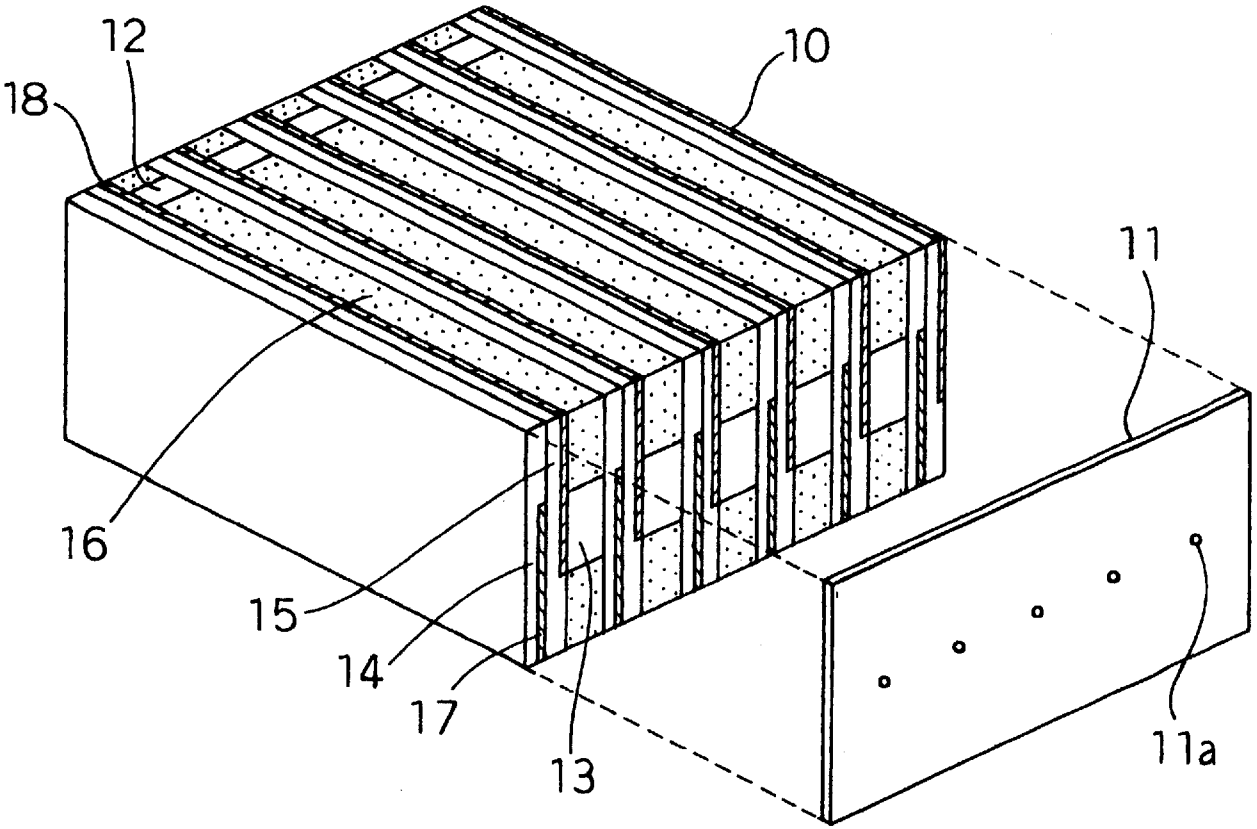
FIG. 1 is a perspective view of an ink jet printing head in accordance with a first embodiment of the present invention.

10 Ink liquid chamber structure
11 Nozzle plate
12 Ink inflow port
13 Ink pressure chamber
14 Regulating plate member
14' Base material for regulating plate member
15 Piezoelectric/electrostrictive Member
15' Base material for piezoelectric/electrostrictive member
16 Pressure chamber member
16' Base material for pressure chamber member
17 Individual electrode
18 Common electrode
19 Electrode pattern
20 Electrode pattern
21 Hole portion
30 Ink liquid chamber structure
31 Nozzle plate
35 Spacer member
36 Wall member
37 Void portion
40 Ink liquid chamber structure
41 Nozzle plate
42 Ink inflow port
43 Ink liquid chamber
44 Electrode member
45 Liquid chamber member
46 Control electrode
47 Signal voltage
48 Bias voltage generator
49 Back electrode
50 Recording paper
110 Ink nozzle portion
111 Ink pump portion
112 Driving portion
201 Piezoelectric element
202 Regulating plate
203 Liquid chamber plate
204 Partition wall plate
207 Pressure chamber
208 Nozzle plate

BEST MODE FOR CARRYING OUT THE INVENTION

Embodiments of the present invention will be described in detail below.

(First embodiment)

A first embodiment of the present invention will be described below with reference to the accompanying drawings.

FIG. 1 is a perspective view of an ink jet printing head of the first embodiment. In FIG. 1, reference numeral 10 denotes an ink liquid chamber structure, 11 denotes a nozzle plate in which a plurality of nozzles 11*a* are arranged in a fixed direction, 12 denotes an ink inflow port, 13 denotes an ink pressure chamber in which a pressure is applied to the ink (corresponding to an ink liquid chamber of the present invention), which is a rectangular parallelepiped shaped ink liquid chamber communicating with the ink inflow port 12, 14 denotes a regulating plate member, 15 denotes a piezoelectric/electrostrictive member, 16 denotes a pressure chamber member, 17 denotes an individual electrode, and 18 denotes a common electrode. The collection of the piezoelectric member 15, the electrodes 17 and 18, and the regulating plate member 14 forms a driving plate-shaped member in accordance with the present invention.

The ink liquid chamber structure 10 is formed by laminating the regulating plate members 14, the piezoelectric/electrostrictive members 15, and the pressure chamber members 16 in succession. Then, the nozzle plate 11 is joined to the ink liquid chamber structure 10 so that the discharge nozzles are arranged corresponding to the openings of the ink pressure chamber 13. Thus, an ink jet printing head is constructed.

Figure 7A:
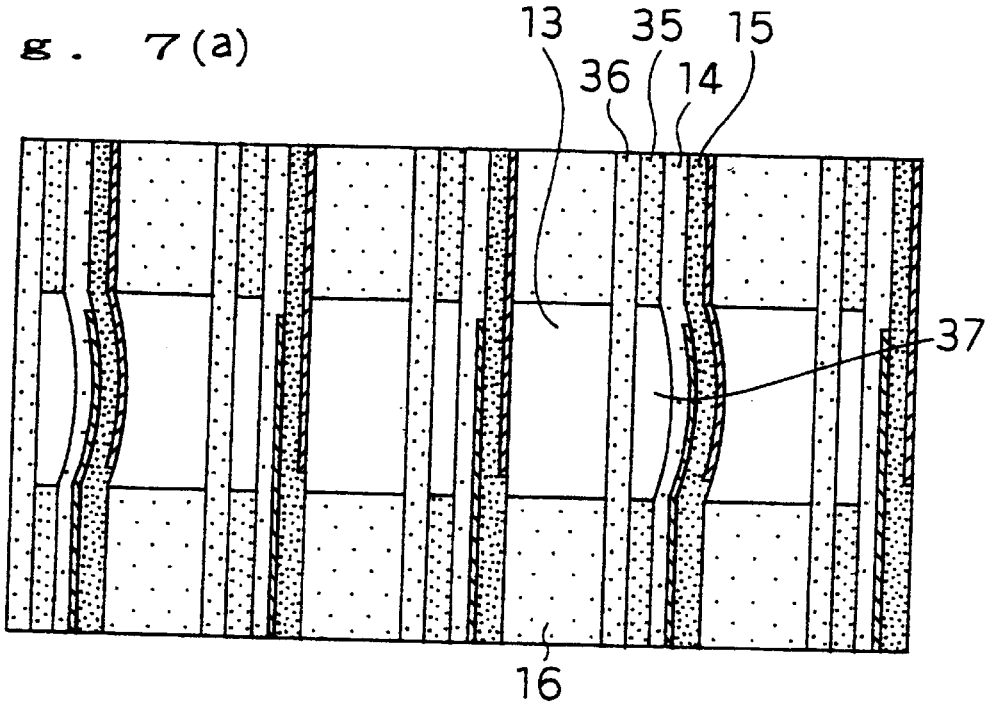
FIG. 7(*a*) and 7(*b*) is a sectional view of an ink jet printing head in accordance with a third embodiment of the present invention.
Figure 7B:
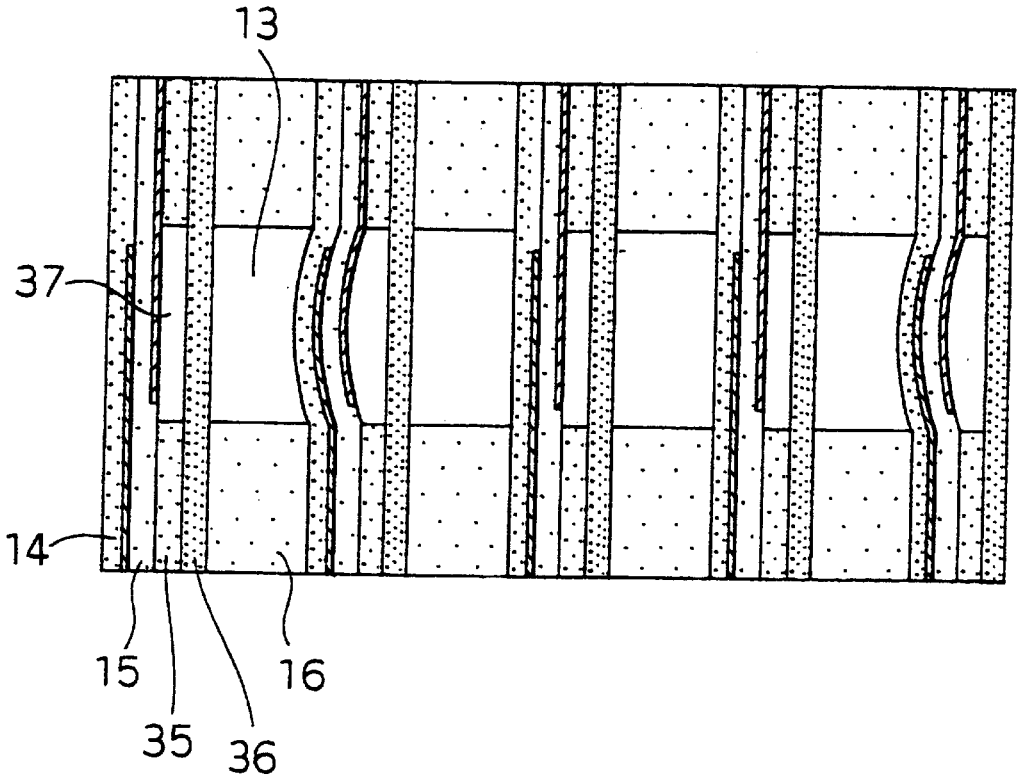

The individual electrode 17 and the common electrode 18 are provided opposingly so as to hold the piezoelectric/electrostrictive member 15 therebetween in such a manner that the common electrode 18 is situated on the side of the ink pressure chamber 13, and the opposing portion is set equal to the width of the ink pressure chamber 13 in the vertical direction in the figure. It is preferable that the width of the opposing portion of the individual electrode 17 and the common electrode 18 be set smaller than the width of the ink pressure chamber 13 in the vertical direction in the figure as shown in FIG. 7 (described later).

The operation of the ink jet printing head thus constructed will be described with reference to the schematic views of FIGS. 2 and 3. These figures are sectional views taken in the direction parallel to the nozzle plate 11 shown in FIG. 1.

Figure 2:
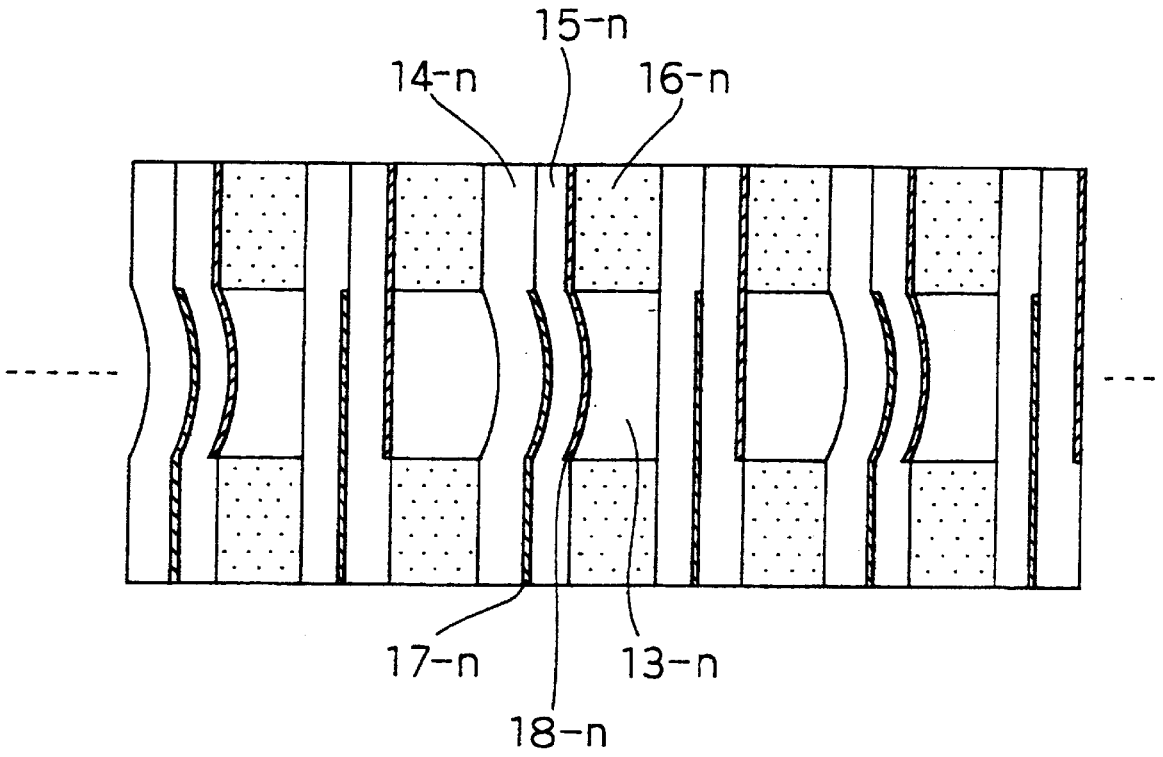
FIG. 2 is a view for illustrating the operation of the ink jet printing head shown in FIG. 1.

First, in FIG. 2, the regulating plate members 14, the piezoelectric/electrostrictive members 15, and the pressure chamber members 16 are laminated in succession. In this figure, the n-th laminated elements are denoted by the regulating plate member 14-n, the piezoelectric/electrostrictive member 15-n, and the pressure chamber member 16-n.

On each side of the piezoelectric/electrostrictive member 15-n, the individual electrode 17-n and the common electrode 18-n are provided individually. When a voltage is applied to between these electrodes, the piezoelectric/electrostrictive member 15-n expands and contracts. Specifically, the common electrode 18 is set at 0 voltage and a signal voltage is applied to the individual electrode 17 to control the discharge of ink droplets.

Assuming that the voltage is applied in the direction such that the piezoelectric/electrostrictive member 15-n expands as shown in FIG. 2, since the regulating plate member 14-n does not move, the regulating plate member 14-n and the piezoelectric/electrostrictive member 15-n deflect to the right as shown in FIG. 2, by which the volume of the ink pressure chamber 13-n is changed to be decreased. As a result, a vibration such as to compress the ink in the ink pressure chamber 13-n is generated, so that ink droplets are discharged through the nozzles.

When the ink in the ink pressure chamber 13-n is compressed, the adjacent ink pressure chamber 13-(n−1) at the left expands and has a negative pressure. Therefore, the discharge control of ink droplets from all nozzles is not effected at the same time, but ink is discharged at least through alternate nozzles.

Figure 3:
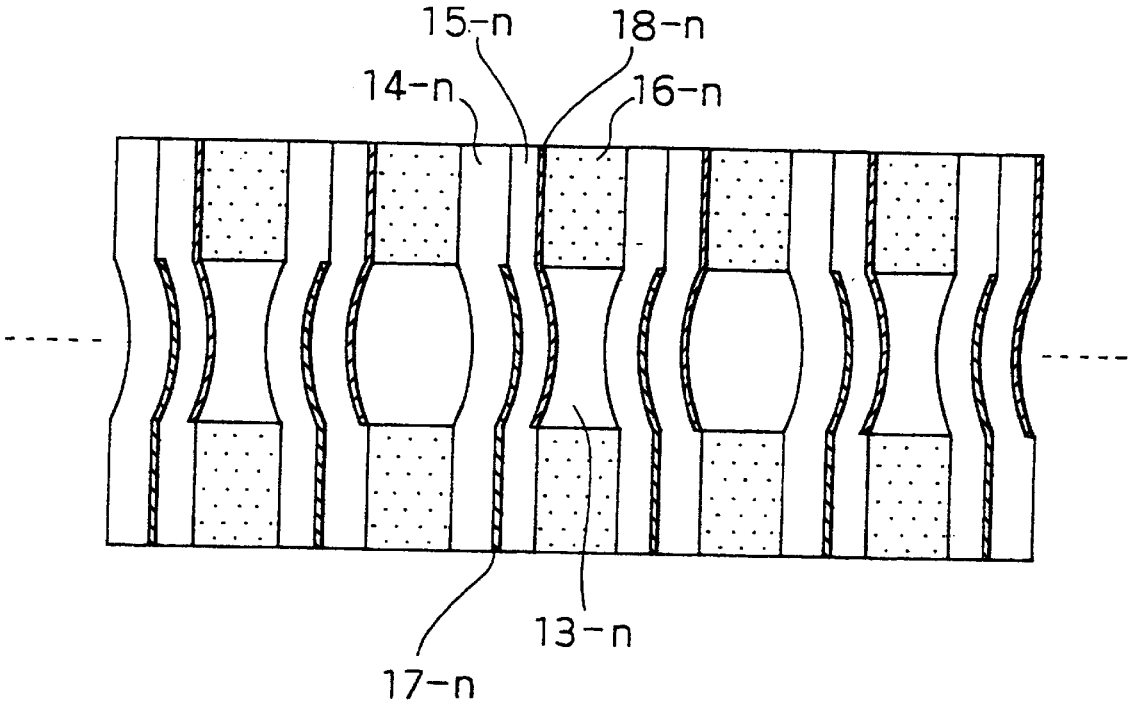
FIG. 3 is a view for illustrating the operation of the ink jet printing head shown in FIG. 1.

Further, as shown in FIG. 3, the piezoelectric/electrostrictive member 15-(n+1) adjacent at the right to the piezoelectric/electrostrictive member 15-n is contracted at the same time, by which it is curved in the direction opposite to the piezoelectric/electrostrictive member 15-n, causing the volume in the ink pressure chamber 13-n to decrease.

In this case, the ink in the ink pressure chamber 13-n can be compressed further, so that ink droplets are discharged by greater compression.

In the aforementioned configuration, the common electrode 18 is provided on the side of the ink pressure chamber 13. This is because consideration is given to the fact that if the electrode is in contact with the ink, when a voltage is applied to the ink and an electric current flows, electrolysis takes place, resulting in the wear of electrode, the deposition of dye, and so on. In this embodiment, the electrode in contact with the ink is the common electrode 18, and its potential is always set at zero, so that such electrolysis does not take place.

Since the ink jet printing head of this embodiment uses a piezoelectric/electrostrictive element 15, at least the piezoelectric/electrostrictive member 15 itself must be made of a piezoelectric/electrostrictive material, but the regulating plate member 14 and the ink pressure chamber member 16 need not be made of a piezoelectric/electrostrictive material, and a metal, plastic, ceramic, etc. can be used for these two elements by making a design considering the mechanical vibration characteristics, fracture strength, and the like.

However, as a simpler and easier configuration, a piezoelectric/electrostrictive material can also be used for these two elements.

Specifically, a piezoelectric/electrostrictive member in which an electrode of a predetermined pattern corresponding to a first electrode is formed on a green sheet of piezoelectric/electrostrictive material, a regulating plate member in which an electrode of a predetermined pattern corresponding to a second electrode is formed on a green sheet of piezoelectric/electrostrictive material, and a pressure chamber member in which hole portions corresponding to the ink pressure chambers are formed on a green sheet of piezoelectric/electrostrictive material are laminated in a green sheet state and compressed, and then are fired as they are, by which an ink liquid chamber structure 10 can be completed.

According to the manufacturing method described above, since laminating and firing are performed by using the same material, a structure which has a little effect of thermal expansion and a high accuracy can be manufactured.

In this case, since the partition wall portion between the ink pressure chambers is formed of a piezoelectric/electrostrictive material, the second electrode is provided on the side of the adjacent ink liquid chamber, and a voltage is applied to between the first and second electrodes to orient the piezoelectric/electrostrictive material of a portion where the electrodes are opposed to each other, by which the partition wall portion itself between the ink pressure chambers can be made an oscillator.

(Second embodiment)

In a second embodiment, the manufacturing method for the ink jet printing head explained in the first embodiment will be described in detail.

Figure 4:
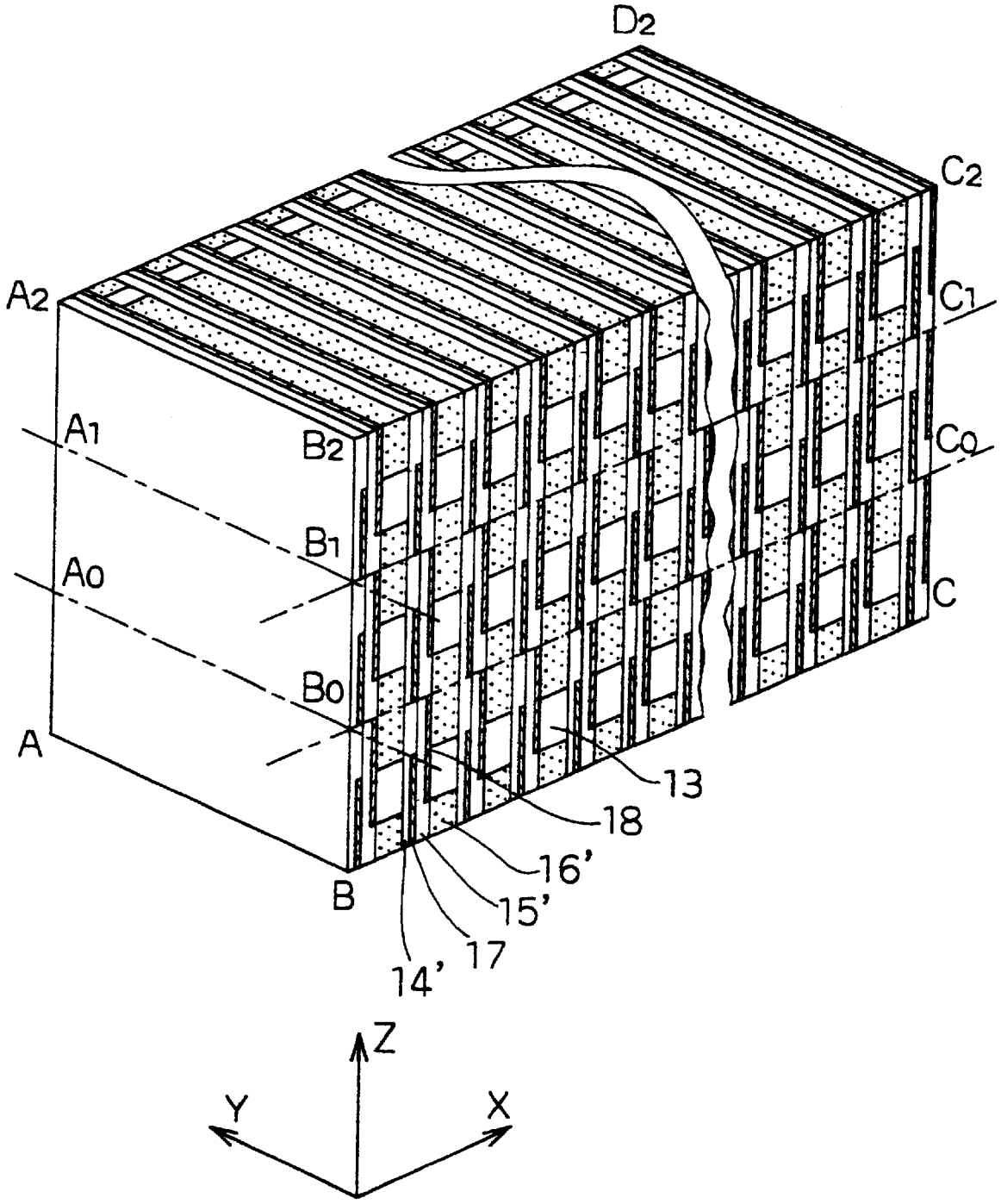
FIG. 4 is a view for illustrating the manufacture of an ink jet printing head in accordance with a second embodiment of the present invention.

FIG. 4 is a view for illustrating a case where a plurality of ink jet printing heads described in the first embodiment are manufactured at the same time.

Referring to FIG. 4, first, base materials 14' for the regulating plate members 14, base materials 15' for the piezoelectric/electrostrictive members 15, and base materials 16' for the pressure chamber members 16 are laminated in succession. These base materials are arranged with the ABC face parallel to the XY plane, and laminated in the direction of X.

By increasing the number of base materials laminated in the direction of X, an ink jet printing head having a large number of nozzles can be manufactured, and by decreasing the thickness of each base material, an ink jet printing head having nozzles arranged with high density can be manufactured.

In the direction of Z, predetermined electrode patterns and hole portions corresponding to each ink jet printing head are formed. These patterns etc. may be equal, or may be different if desired. This also holds true for the direction of Y.

After the laminating operation, in order to form, for example, three ink jet printing heads, the base materials are cut at $A_0B_0C_0$ face and $A_1B_1C_1$ face parallel to the ABC face.

Figure 5:
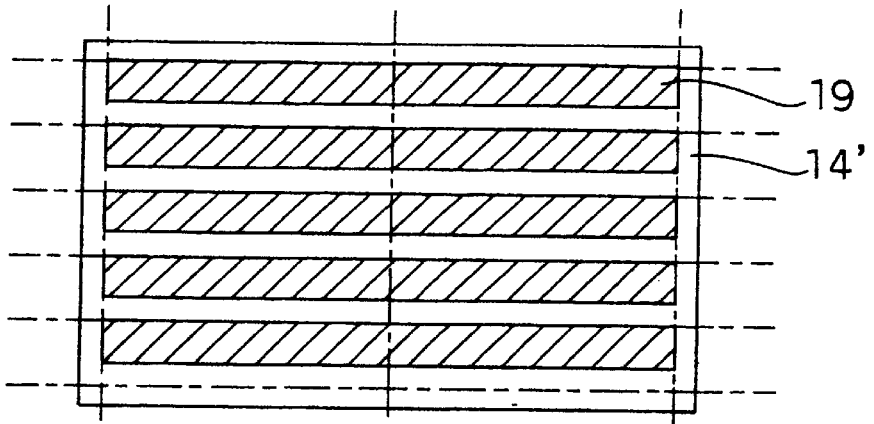
FIG. 5 is a view showing typical configurations of base materials before the laminating of the ink jet printing head shown in FIG. 4.
Figure 5:
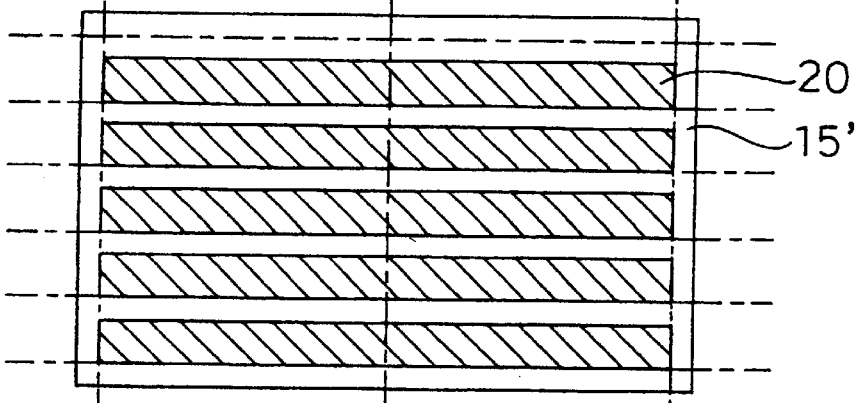
Figure 5:
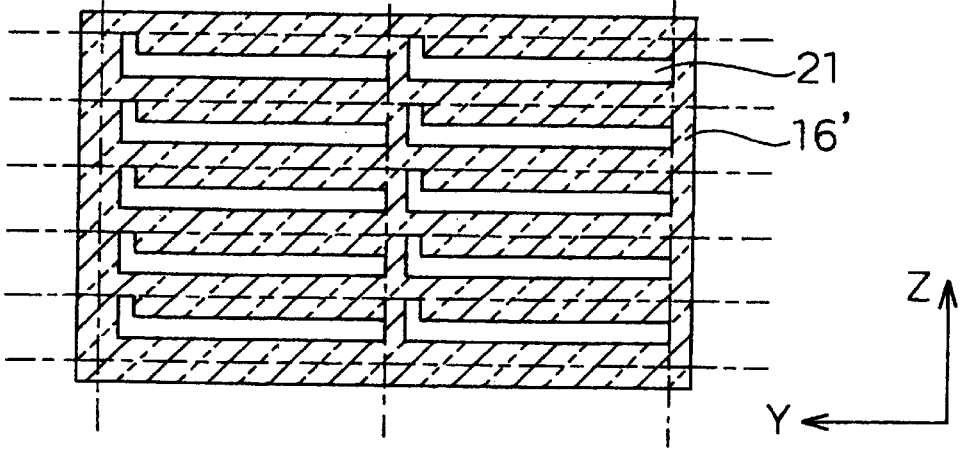

Next, the typical configuration of each base material before laminating operation is shown in FIG. 5.

FIG. 5(*a*) shows the base material 14' for the regulating plate member, in which five and two electrode patterns 19 are formed in the direction of Z and Y, respectively.

FIG. 5(*b*) shows the base material 15' for the piezoelectric/electrostrictive member, in which five and two electrode patterns 20 are formed in the direction of Z and Y, respectively.

FIG. 5(*c*) shows the base material 16' for the pressure chamber member, in which five and two hole portions 21, each of which forms the ink pressure chamber and ink inflow port, are formed in the direction of Z and Y, respectively.

These three base materials are repeatedly laminated in succession, and then cut and separated as described above, by which a total of ten laminated bodies of ink jet printing heads can be manufactured.

Since the width of the nozzle plate 11 (the length in the direction perpendicular to the arrangement direction of the nozzles 11*a*) is generally very small, for example, approx. 0.3 to 3 mm, the handling of the nozzle plate 11 is very difficult to perform in joining the nozzle plate 11 to the ink liquid chamber structure 10 in this state.

Figure 6:
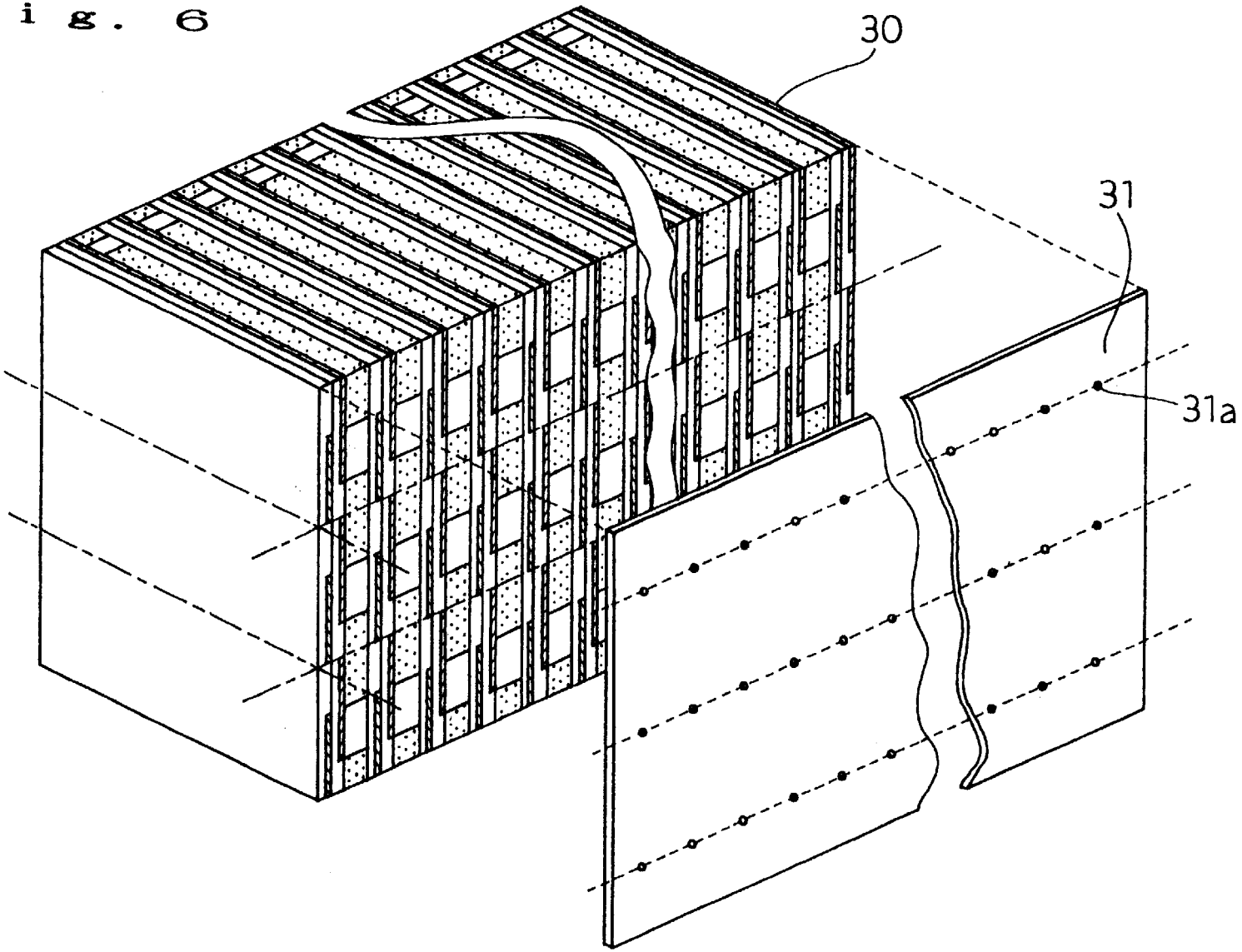
FIG. 6 is a view for illustrating the manufacture the ink jet printing head shown in FIG. 4.

Therefore, as shown in FIG. 6, an ink liquid chamber structure 30 and a nozzle plate 31 for a plurality of ink jet printing heads are joined to each other before the ink liquid chamber structure 30 is cut and separated, and they are separated after joining, by which the aforementioned difficulty can be avoided.

By such a configuration, if the ink liquid chamber structure 30 and the nozzles 31*a* of the nozzle plate 31 are aligned accurately, the handling is very easy, and a plurality of ink jet printing heads can be manufactured accurately at a time.

Needless to say, in some cases, the base material for the nozzle plate is not joined, and a small nozzle plate may be joined to each of cut and separated ink liquid chamber structure 30.

When a color ink jet printing head is manufactured, in FIG. 4, the ink liquid chamber structure is not separated into three layers, but a color ink jet printing structure can be manufactured without being separated so that the head of layer indicated by $ABCC_0B_0A_0$ is used for color C, the head of layer indicated by $A_0B_0C_0C_1B_1A_1$ is used for color M, and the head of layer indicated by $A_1B_1C_1C_2B_2A_2$ is used for color Y. Further, a layer for black may be added around the ink liquid chamber structure.

(Third embodiment)

Next, an ink jet printing head in accordance with a third embodiment of the present invention will be described with reference to the drawings.

FIG. 7(*a*) is a sectional view taken in the direction parallel to the nozzle plate of the ink jet printing head of this embodiment.

In this embodiment, a spacer member 35 and a partition wall member 36 are provided as compared with the configuration of the first embodiment.

Specifically, five plate-shaped members of the regulating plate member 14, piezoelectric/electrostrictive member 15, pressure chamber member 16, partition wall member 36, and spacer member 35 are laminated in succession to form the ink jet printing head.

Accordingly, a void portion 37 can be formed by the piezoelectric/electrostrictive member 15, spacer member 35, and partition wall member 36.

This void portion 37 is provided for the reason that even if the piezoelectric/electrostrictive member 15 is deformed curvedly toward the ink pressure chamber 13 on the right side in the figure by being extended, merely the void portion 37 expands, and there is no interference in the left-side ink pressure chamber 13. For this purpose, the partition wall member 36 is made of a hard material. Thus, there is no interference in volume change between the adjacent ink pressure chambers 13.

Specifically, explaining with reference to FIG. 7(*a*), the vibration of the piezoelectric/electrostrictive member 14 affects only the volume change of the ink pressure chamber 13 lying at the right, so that the structure is such that each of the ink pressure chambers 13 is independently provided with the piezoelectric/electrostrictive member 15.

Contrarily, in the ink jet printing head shown in FIG. 7(*b*), the positions of the partition wall member 36 and the spacer member 35 are different from those shown in FIG. 7(*a*).

Specifically, five plate-shaped members of the regulating plate member 14, piezoelectric/electrostrictive member 15, spacer member 35, partition wall member 36, and pressure chamber member 16 are laminated in succession, by which the ink jet printing head is formed. The void portion 37 is provided to prevent interference in the partition wall member 36 even if the piezoelectric/electrostrictive member 15 is deformed curvedly toward the partition wall member 36. Since the partition wall member 36 is a member that is always fixed and does not vibrate, there is no interference in volume change between the adjacent ink pressure chambers 13.

In this embodiment, therefore, unlike the first embodiment, the control of discharge from the nozzles is not carried out alternately, but the control of discharge from all the nozzles can be carried out at the same time.

Needless to say, other configurations can be used to prevent the vibration from being propagated to the ink pressure chamber on one side. For example, a vibration isolating material may be disposed in place of the void portion to absorb the vibration and prevent its propagation. The opposing portion of the electrodes should preferably be shorter than the void portion or the vibration isolating material as shown in the figure.

(Fourth embodiment)

In a fourth embodiment is described an example in which a configuration such that plate-shaped members are laminated is applied to an ink jet printing head having an operation principle other than that described above.

Figure 8A:
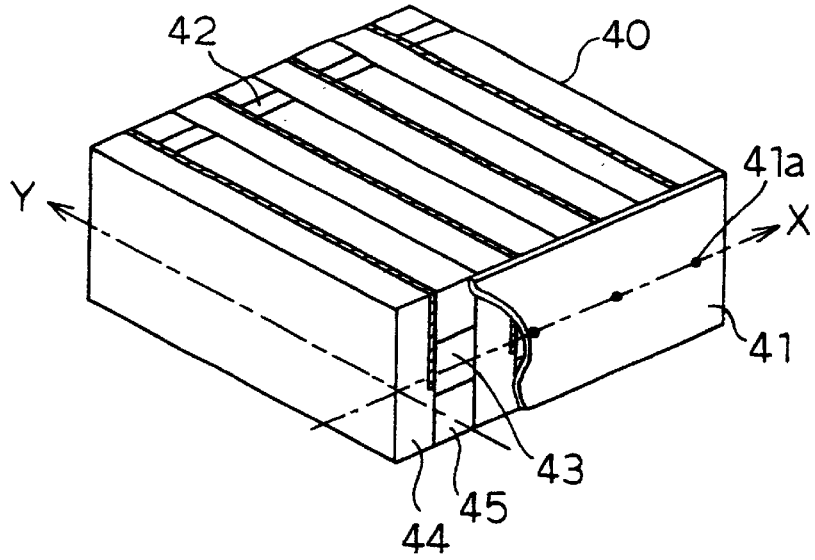
FIG. 8(*a*) and 8(*b*) is a view showing a configuration of an ink jet printing head in accordance with a fourth embodiment the present invention.
Figure 8B:
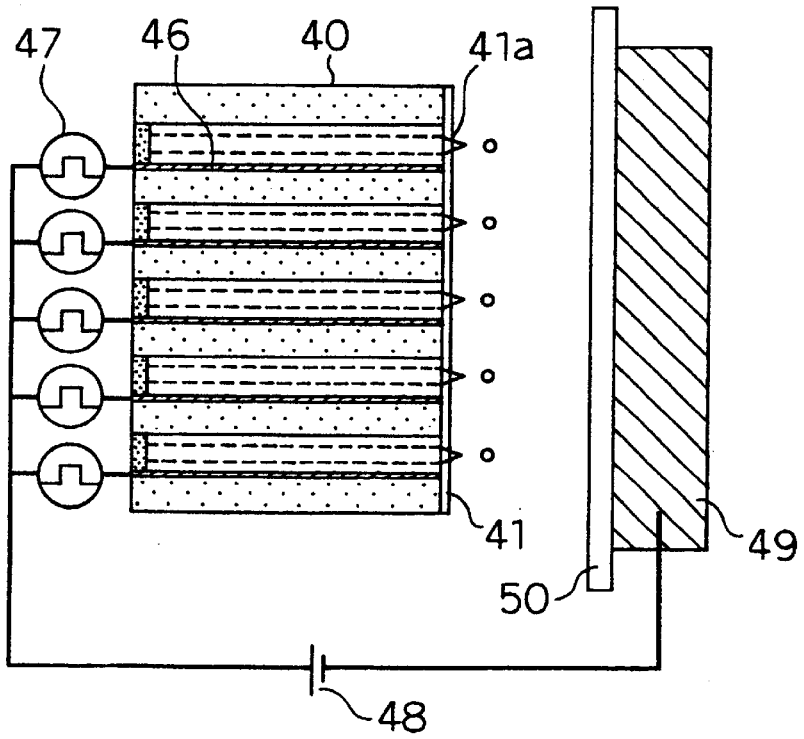

FIG. 8 shows a typical configuration applied to an electrostatic attraction type ink jet.

FIG. 8(*a*) is a perspective view of an electrostatic attraction type ink jet printing head, and FIG. 8(*b*) is a sectional view taken along the XY plane of FIG. 8(*a*).

In FIG. 8, reference numeral 40 denotes an ink liquid chamber structure configured by laminating plate-shaped members, 41 denotes a nozzle plate having a plurality of nozzles 41*a*, 42 denotes an ink inflow port, 43 denotes an ink liquid chamber, 44 denotes a plate-shaped electrode member, 45 denotes a plate-shaped liquid chamber member having a hole portion corresponding to the ink inflow port 42 and the ink liquid chamber 43, 46 denotes a control electrode, 47 denotes a signal voltage, 48 denotes a bias voltage generator, 49 denotes a back electrode, and 50 denotes a recording paper.

The ink liquid chamber structure 40 is assembled by laminating the electrode members 44 and the liquid chamber members 45 in succession in the nozzle arrangement direction, that is, in the X-axis direction in the figure.

Then, the nozzle plate 41 is joined to the ink liquid chamber structure 40 thus configured, by which the ink jet printing head is manufactured.

In this configuration, ink flows through the ink inflow port 42, fills the ink liquid chamber 43, and can be discharged through the nozzles 41*a* as ink droplets.

More specifically, when a sufficient electric field is applied to between the control electrode 46, which is opposed to the back electrode 48 via the recording paper 49 and disposed in each ink liquid chamber 43, and the back electrode 49, the ink droplets are discharged through the nozzles 41*a*.

The bias voltage generator 48 applies a predetermined bias electric field to a discharging electric field to lower the signal voltage 47.

The configuration of laminating plate-shaped members can be applied to not only such an electrostatic attraction type system but also other systems such as a thermal ink jet printing head in which ink is caused to boil by a heater and discharged by the pressure waves.

For example, a thermal ink jet printing head can be configured by providing an exothermic resistor (heating means) in place of the control electrode 46 in the vicinity of nozzle of the control electrode 46 in FIG. 8 and by applying a signal voltage thereto. Needless to say, in this case, the back electrode 49 is unnecessary.

(Fifth embodiment)

Figure 9:
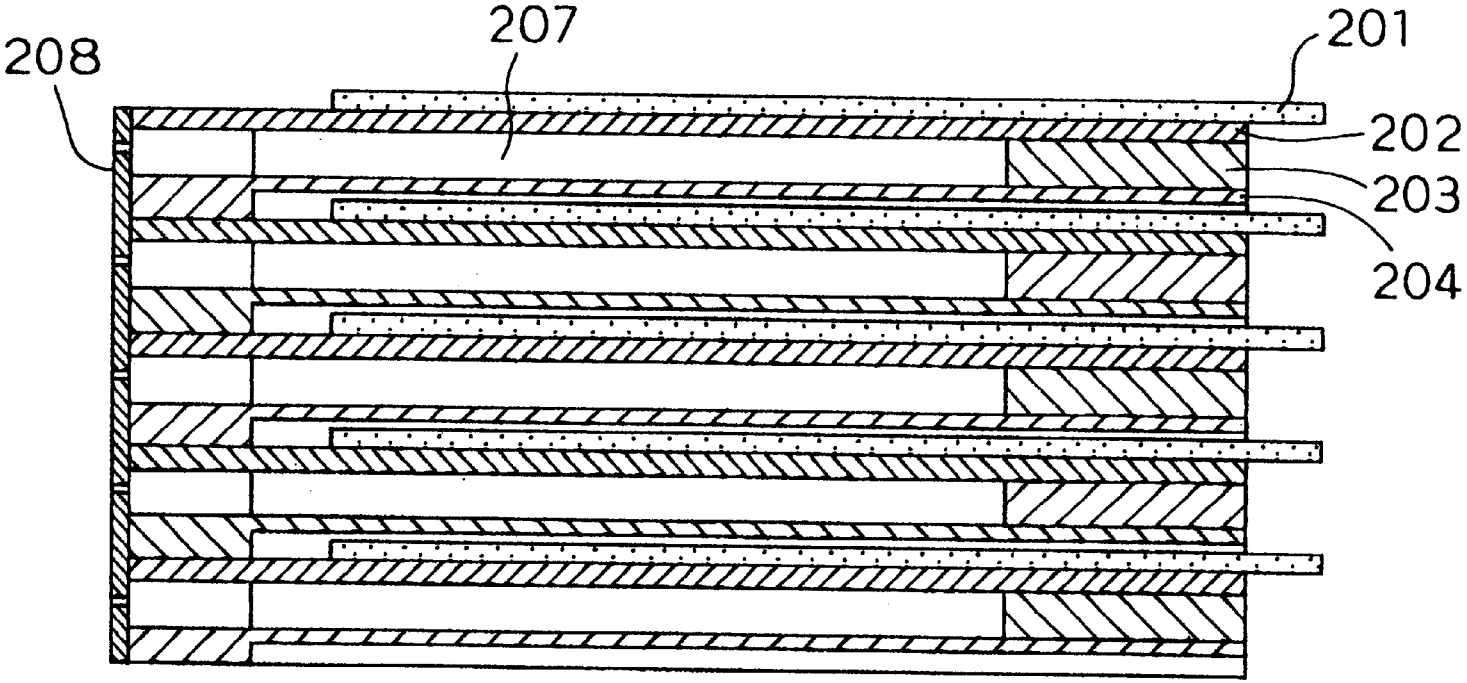
FIG. 9 is a view showing a configuration of an ink jet printing head in accordance with a fifth embodiment the present invention.

FIG. 9 shows a configuration of an ink jet printing head in accordance with a fifth embodiment. In FIG. 9, a regulating plate 202 to which a piezoelectric element 201 is joined, a liquid chamber plate 203 which is formed with a pressure chamber 207, and a partition wall plate 204 which is formed with a recess not to hinder the movement of the piezoelectric element 201 when being laminated are repeatedly laminated in succession, by which the ink jet head structure is formed.

Figure 10:
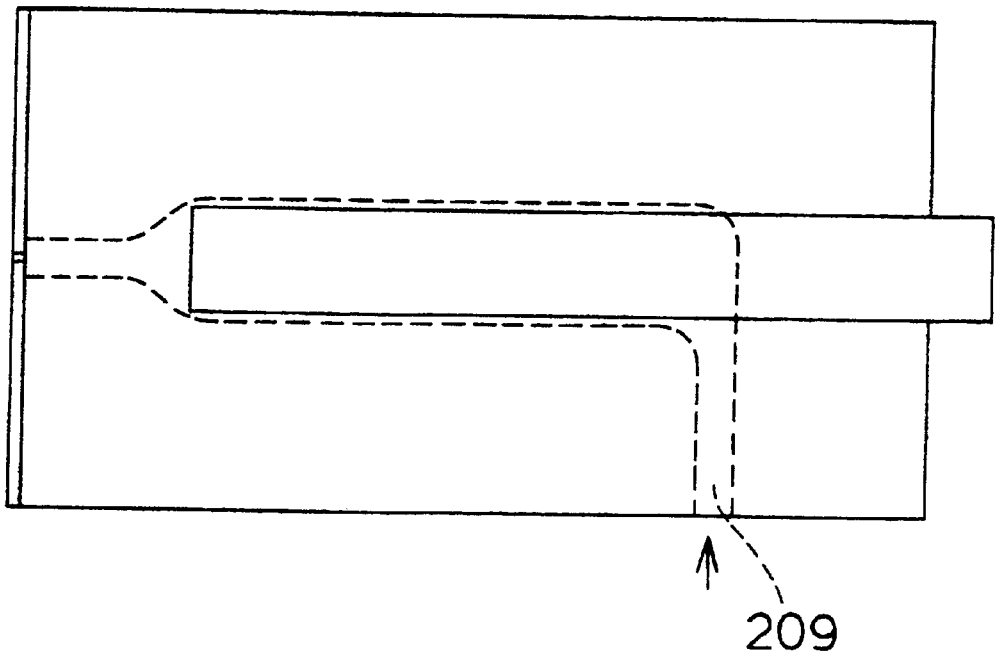
FIG. 10 is a front view of the ink jet printing head shown in FIG. 9.

As shown in FIG. 10, ink is filled in the pressure chamber 207 through an ink inflow port 209, and ink droplets are discharged through a nozzle formed in a nozzle plate 208.

Figure 11:
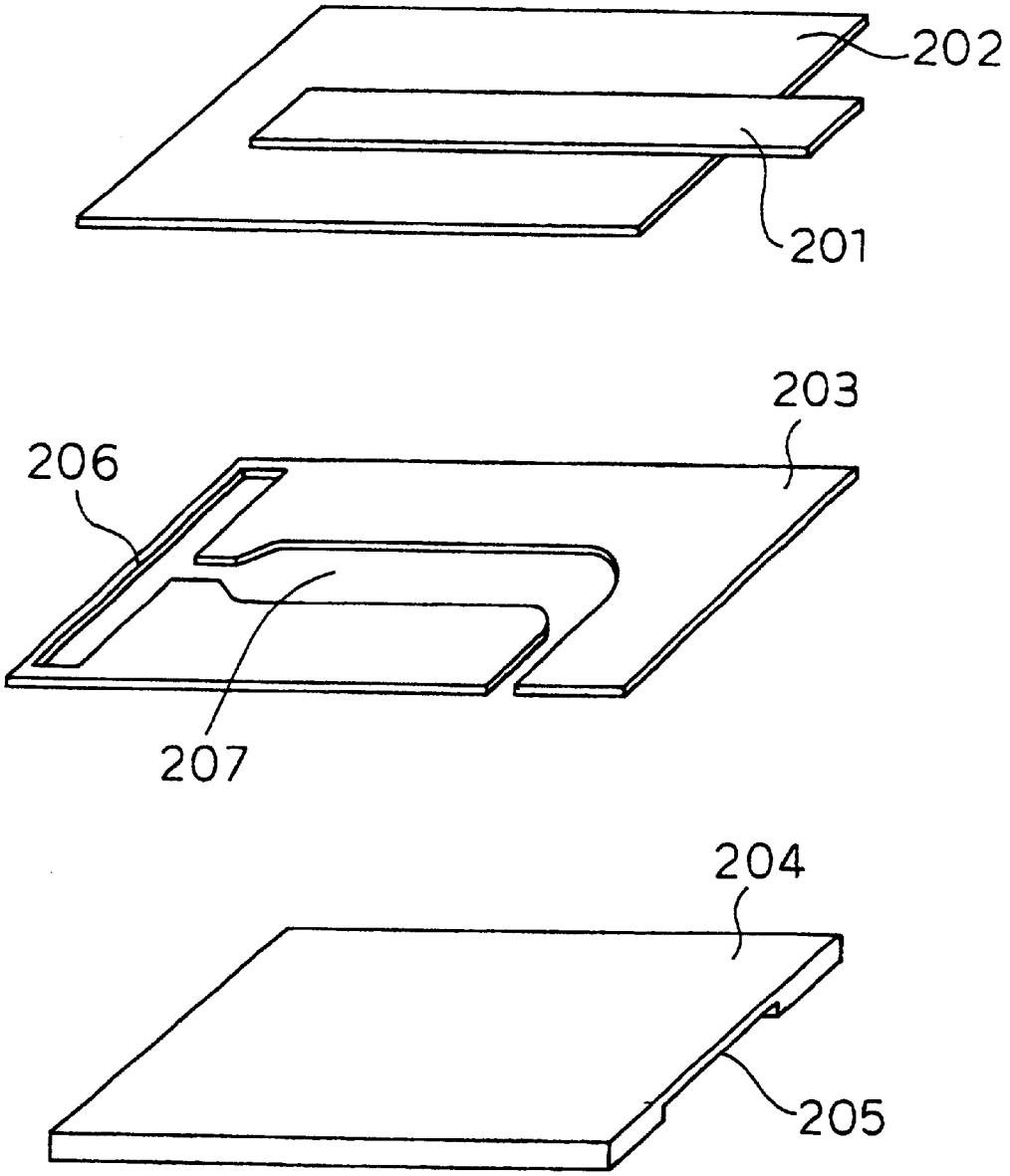
FIG. 11 is a perspective view showing a manufacturing method for the ink jet printing head shown FIG. 9.
Figure 12A:
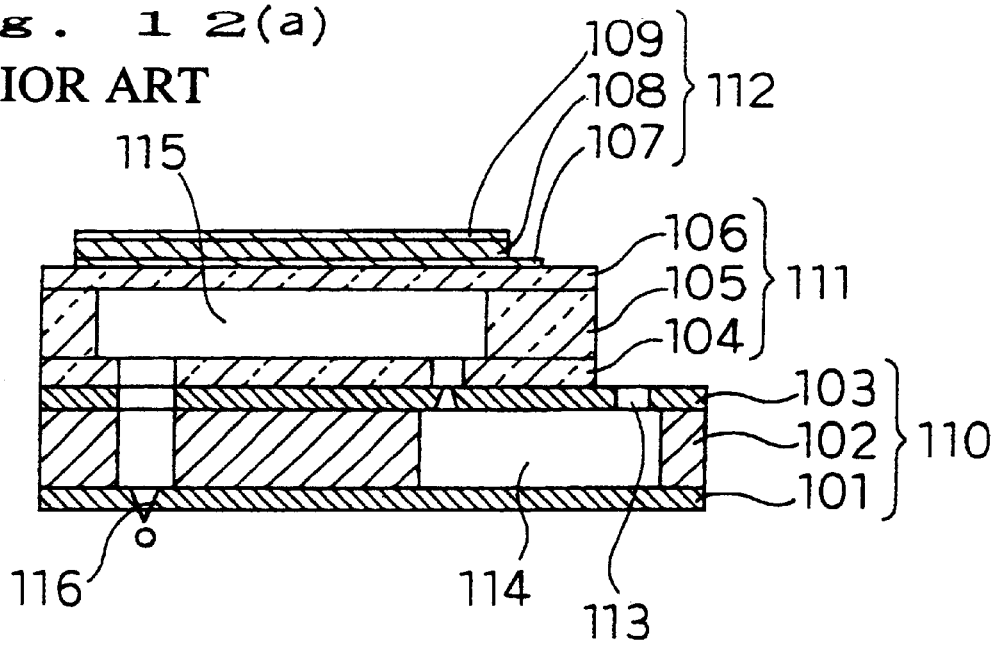
Fig. 12(a) PRIOR ART
FIG. 12(*a*) is a sectional view of a conventional ink printing head and FIG. 12(*b*) is a top view thereof.
Figure 12B:
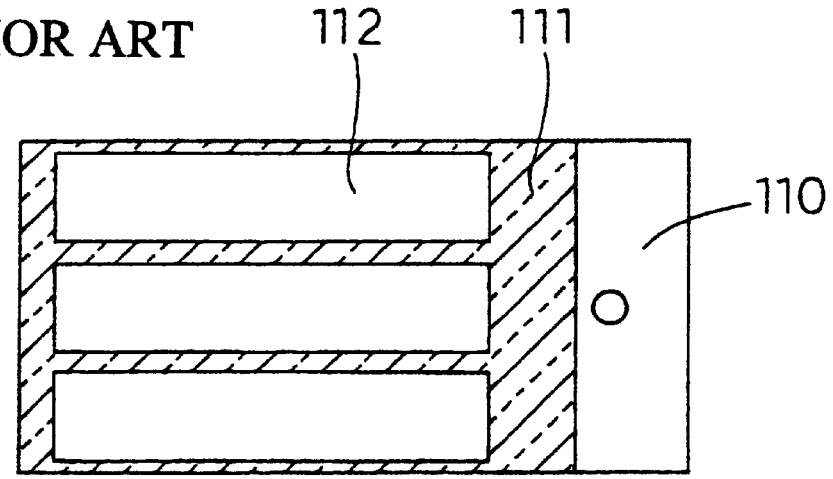
Fig. 12(b) PRIOR ART

FIG. 11 is a perspective view showing a way of assembling the structure shown in FIG. 9. The regulating plate 202 to which the piezoelectric element 201 is joined, the liquid chamber plate 203 which is formed with the pressure chamber 207, and the partition wall plate 204 which is formed with the recess 205 to prevent direct contact with the piezoelectric element 201 are lapped as shown in FIG. 9 to form the structure. The liquid chamber plate 203 is integrated by a support portion 206 to prevent the separation of members. This support portion 206 is removed after the structure is manufactured.

In the ink jet head of the structure shown in FIG. 9, the nozzles are arranged in the direction in which plate materials are laminated, by which a multi-nozzle head is completed. That is to say, the total of the thicknesses of the regulating plate 202, liquid chamber plate 203, and partition wall plate 204 is equal to the nozzle pitch. Accordingly, in order to provide an ink jet head with high-density nozzle arrangement, it is necessary only that thin plate materials are used for laminating, and the width of the pressure chamber need not be decreased. Therefore, greater nozzle density can be achieved without deterioration in performance.

The structure shown in FIG. 9 uses a metal such as a stainless steel. The pressure chamber 207 in the liquid chamber plate 203 and the recess 205 in the partition wall plate 204 are easily formed by metal etching. To laminate these plate members, they may be bonded by using an adhesive, or may be thermo-compression bonded by sandwiching a sheet-shaped adhesive between them. Also, there is available a method in which the plate members are plated with gold and laminated, and then bonded directly by diffusion bonding of gold.

In trial production, a stainless steel with a thickness of about 30 $\mu$m was used for the regulating plate 202, and a piezoelectric/electrostrictive element with a thickness of 40 $\mu$m was bonded to the regulating plate using an epoxy adhesive. The liquid chamber plate 203 made of a stainless steel with a thickness of 200 $\mu$m was formed with the liquid chamber 1 mm wide and 4 mm long by etching. The partition wall plate 204 made of a stainless steel with a thickness of 150 $\mu$m was formed with the recess having a thickness of about 70 $\mu$m by half etching. These three sheet members including the piezoelectric/electrostrictive element were laminated in succession using an epoxy adhesive, by which the bonding layer became about 20 $\mu$m in thickness and multi-nozzle head having about two nozzles per millimeter was completed. With this head, satisfactory discharge of ink droplets was observed by pulse drive of a low voltage of about 5 volts. A head with higher-density nozzle arrangement can be manufactured by decreasing the thicknesses of the liquid chamber plate 203 and the partition wall plate 204.

Industrial Applicability

As described above, according to the present invention, the multi-nozzle ink jet printing head having the plurality of nozzles is constructed by laminating the plate-shaped members in the nozzle arrangement direction. By using thin plate-shaped members, the ink liquid chambers with a shallow depth can be arranged with high density, so that the ink jet printing head corresponding to the high-density nozzle arrangement can be realized easily.

Also, the pattern formed in the plate-shaped member may be a relatively simple one with a large size as compared with the nozzle arrangement density, so that the fabrication is simple and the manufacture is easy. If cutting and separating are performed after laminating, a plurality of ink jet printing heads can be manufactured at a time, so that an ink jet printing head with very high productivity can be provided.

What is claimed is:

1. An ink jet printing head comprising:

a succession of laminated groups, each group including a wall and a chamber member, each having a longitudinal dimension and a transverse dimension;

the wall and the chamber member laminated together in the transverse dimension, and each group laminated in a cooperating relationship to an adjacent group in the transverse dimension to form between each group individual chambers for receiving ink;

each chamber formed by first and second longitudinal surfaces of a wall of one group and a wall of an adjacent group; and the wall of each group including a driving member for discharging the ink from the chamber;

wherein said chambers are aligned vertically side by side.

2. An ink jet printing head according to claim 1, wherein each of said driving members includes:

a piezoelectric/electrostrictive member;

first and second electrode members disposed adjacently on opposite sides of said piezoelectric/electrostrictive member; and a regulating plate member disposed adjacently to said second electrode member on a side of said second electrode member; and a respective chamber formed by a hole portion of the chamber member disposed adjacently to said first electrode member on a side of said first electrode member;

wherein extension or contraction deformation is allowed to occur on said piezoelectric/electrostrictive member by applying a voltage to said first and second electrode members, and said regulating plate member regulates the extension or contraction deformation of said piezoelectric/electrostrictive member, whereby the ink in said respective chamber is pressurized and ink droplets are discharged through a nozzle corresponding to said respective chamber.

3. An ink jet printing head according to claim 2, wherein extension deformation is allowed to occur on every other of said piezoelectric/electrostrictive members in the succession of laminated groups, by which ink droplets are discharged through nozzles corresponding to chambers which are respectively adjacent to the extension deformed piezoelectric/electrostrictive members without an interposition of a regulating plate member, and ink droplets are not discharged through remaining nozzles.

4. An ink jet printing head according to claim 2, wherein extension deformation is allowed to occur on every other of said piezoelectric/electrostrictive members in the succession of laminated groups, and contraction deformation is allowed to occur on piezoelectric/electrostrictive members other than said extension deformed piezoelectric/electrostrictive members, by which ink droplets are discharged through nozzles corresponding to chambers which are respectively adjacent to the extension deformed piezoelectric/electrostrictive members without an interposition of a regulating plate member, and ink droplets are not discharged through remaining nozzles.

5. An ink jet printing head according to any one of claims 1 and 2 to 4, wherein said first electrode is a common electrode in each of the driving members.

6. An ink jet printing head according to claim 2, wherein extension/contraction motion propagation preventive means for preventing propagation of contraction or extension deformation of said piezoelectric/electrostrictive member to an undriven chamber is provided between said piezoelectric/electrostrictive member and a chamber which is adjacent to said piezoelectric/electrostrictive member without an interposition of said regulating plate member or provided between said regulating plate member and a chamber which is adjacent to said regulating plate member, whereby ink droplets are discharged through all nozzles.

7. An ink jet printing head according to claim 2, wherein said piezoelectric/electrostrictive member, said regulating plate member, and said chamber member are formed of a piezoelectric ceramic having the same property.

8. An ink jet printing head according to claim 6, wherein a void portion is used as said extension/contraction motion propagation preventive means.

9. An ink jet printing head according to claim 8, wherein a width with which said first and second electrode members are opposed to each other is smaller than a width of said void portion.

10. An ink jet printing head according to claim 6, wherein said extension/contraction motion propagation preventive means is a vibration isolating member.

11. An ink jet printing head according to claim 1, wherein said wall has an electrode of electrostatic ink jet and an electrode member disposed adjacently to said electrode.

12. An ink jet printing head according to claim 1, wherein said wall has heating means for a heating type ink jet.

13. The ink jet printing head of claim 1, wherein the driving member includes a piezoelectric element and at least one electrode, and the piezoelectric element and the electrode are laminated in the transverse dimension.

14. The ink jet printing head of claim 1, wherein each chamber is further defined by first and second transverse surfaces formed by a chamber member of each group.

* * * * *

UNITED STATES PATENT AND TRADEMARK OFFICE

CERTIFICATE OF CORRECTION

PATENT NO. : 6,299,295 B1
DATED : October 9, 2001
INVENTOR(S) : Miura et al.

It is certified that error appears in the above-identified patent and that said Letters Patent is hereby corrected as shown below:

Title page,
Item [56], References Cited, "Yamamure et al." should read -- Yamamuro et al. --.

Signed and Sealed this

Twenty-seventh Day of August, 2002

*Attest:*

*Attesting Officer*

JAMES E. ROGAN
*Director of the United States Patent and Trademark Office*